United States Patent [19]

Carlson

[11] Patent Number: 5,002,504

[45] Date of Patent: Mar. 26, 1991

[54] ELECTRICAL CONNECTOR LATCH CONSTRUCTION

[75] Inventor: Thomas J. Carlson, Carol Stream, Ill.

[73] Assignee: Labinal Components & Systems, Inc., Elk Grove Village, Ill.

[21] Appl. No.: 422,157

[22] Filed: Oct. 16, 1989

[51] Int. Cl.[5] ..... H01R 11/00

[52] U.S. Cl. ..... 439/599; 439/595; 439/603

[58] Field of Search ..... 439/595, 596, 597, 598, 439/599, 603

[56] References Cited

U.S. PATENT DOCUMENTS 4,679,874 7/1987 Saijo et al. ..... 439/595
4,705,337 11/1987 Maeda ..... 439/595
4,711,508 12/1987 Sueyoshi ..... 439/603
4,750,893 6/1988 Sueyoshi et al. ..... 439/596
4,767,361 8/1988 Hoshino et al. ..... 439/603

*Primary Examiner*—Paula A. Bradley
*Attorney, Agent, or Firm*—Joseph P. Calabrese

[57] ABSTRACT

A secondary latch is provided for securing contacts which are located in desired position in passageways of an insulator relative to a mating face. The insulator has at least one opening whereby locking shoulders of the positioned contacts are accessible from the insulator exterior. A latch finger of the latch which is secured to the insulator exterior has a detent end which enters the insulator opening and latches the engaged contacts to the insulator.

14 Claims, 3 Drawing Sheets

FIG. 3
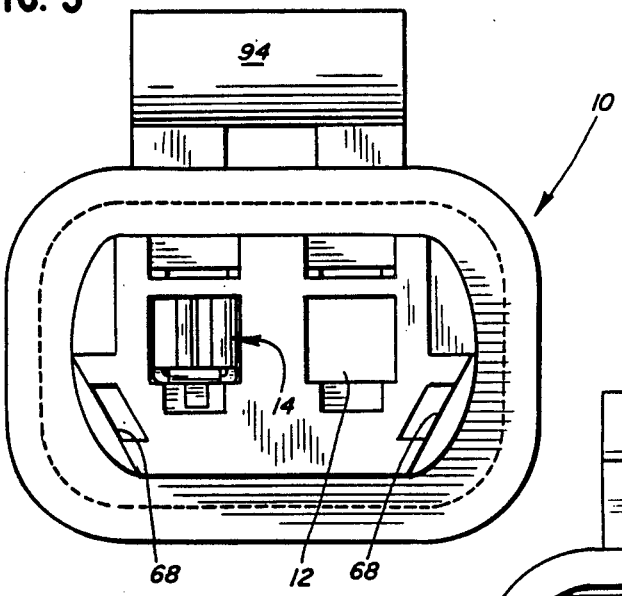
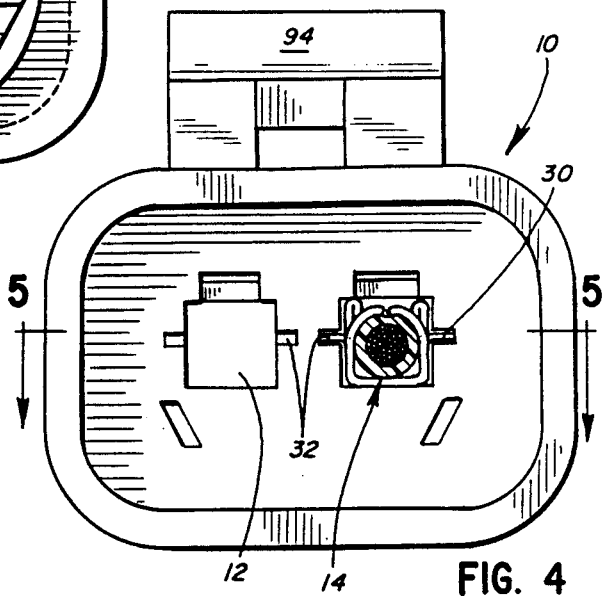
FIG. 4
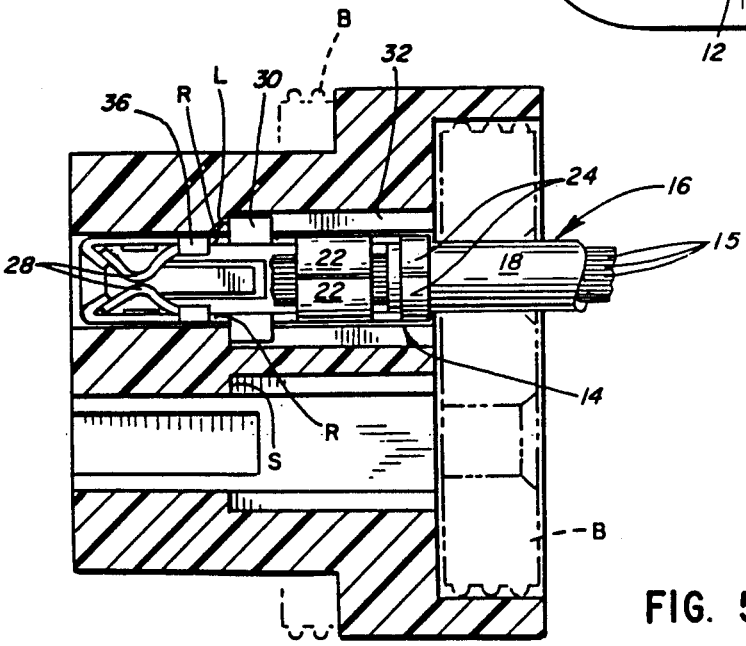
FIG. 5

FIG. 7
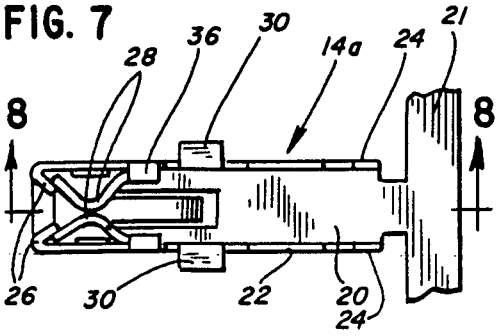
FIG. 8
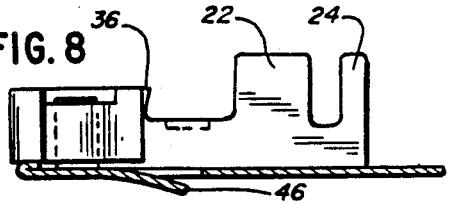
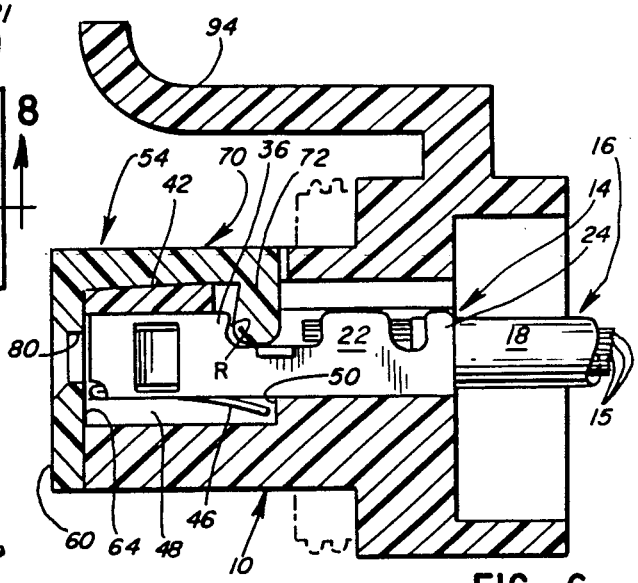
FIG. 6
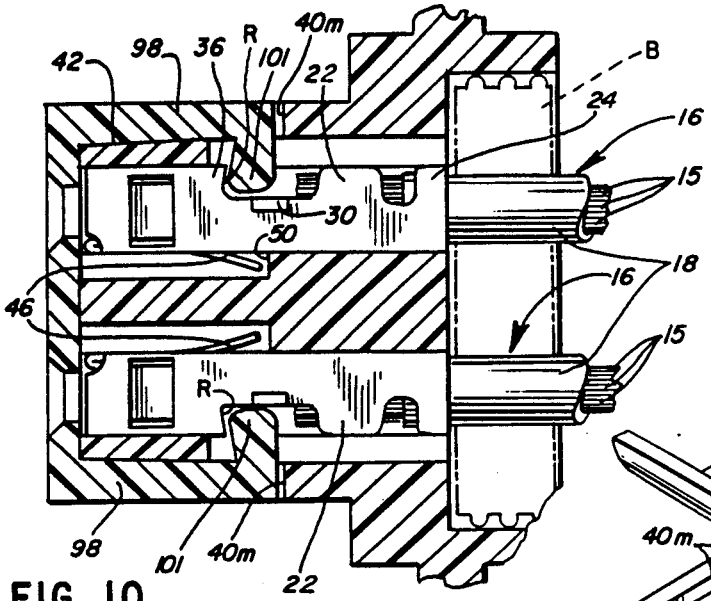
FIG. 10
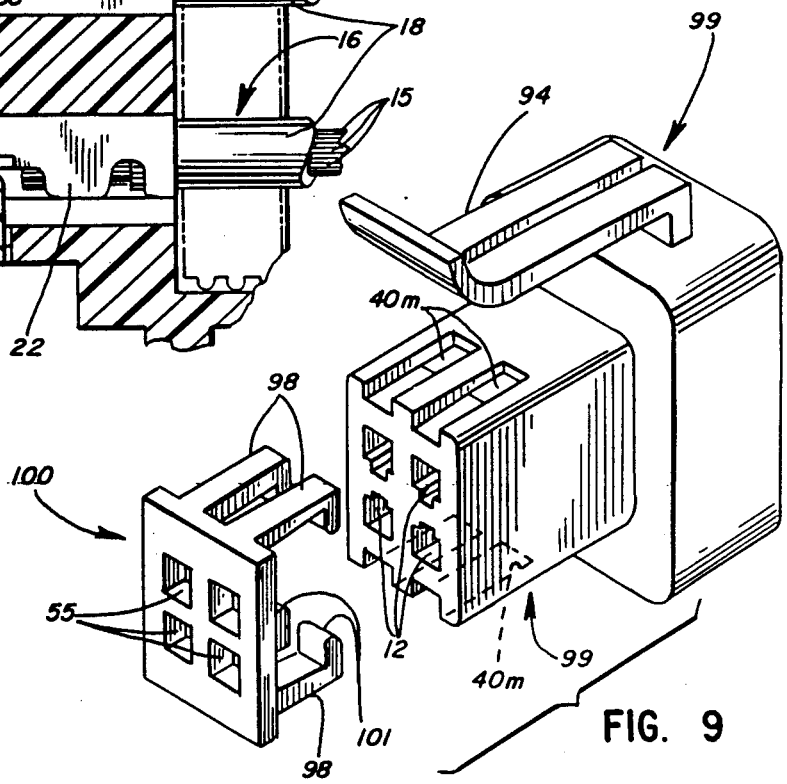
FIG. 9

ELECTRICAL CONNECTOR LATCH CONSTRUCTION

BACKGROUND OF THE INVENTION

1. Field of the Invention

This invention relates to an electrical connector construction, and more particularly this invention pertains to a secondary latch for use with an electrical connector and associated contacts. Such latch assures retention of contacts in a connector insulator both prior and subsequent to mating with contacts of a mating connector.

2. Description of the Prior Art

The use of secondary latches for use in conjunction with electrical connectors is known as the art. Such secondary latches positively interlock with a connector insulator and contacts therein for purposes of assuring contact retention in insulator passageways in which disposed. Such latches are adapted for use in a variety of applications where contact-insulator disengagement is particularly to be avoided. Thus such latches are in use in the automotive industry where the wiring is subject to constant movement, including occasional abrupt movement, in the course of vehicle travel. Such continual vehicular movement must not result in contact disengagement with a break in an electrical circuit and resultant power loss in one or more vehicle functions. Such power loss obviously could eventuate in a dangerous situation as in power-operated accessory failure loss in busy traffic or headlight loss at night.

Secondary latches of the prior art are often subject to one or more difficulties in use. Some latches may comprise locking plates which are snapped into position in an insulator for contact-retention purposes. Such contacts are often small in size so as to be manipulated into place only with great difficulty. Also, the small size of such latching devices and their disposition in the connector interior renders visual inspection difficult and at times indeterminate of the true "locked in" condition of the contacts.

Also, in prior art connectors employing secondary latching, side-action molding or difficult core pin configurations are commonly employed in the course of manufacture.

It is therefore an object of this invention to provide a connector insulator construction employing secondary latching which eliminates side-action molding whereby production is simplified and costs are desirably reduced.

It is another object of this invention to provide a novel discrete secondary latch construction for use with a connector insulator. Such latch positively engages and locks electrical contacts to the insulator housing in which such contacts are disposed, rather than relying solely upon a locking means formed from the contact bodies themselves for retaining the contacts within the insulator housing in which disposed.

It is a further object of this invention to provide a secondary latching means for securing contacts within an insulator and in addition, also serves to align mating contacts entering the insulator. The provided latching means thus provides efficient contact-to-contact engagement, thereby preventing damage to the mating contacts occasioned by misalignment, and assuring maximum contact working life.

It is yet another object of this invention to provide an insulator housing which allows precise location of contacts within contact-receiving passageways therein. The housing also permits readily-visible contact-secondary latch engagement as well as a snap-action secondary latching means engagement with contacts while the latter are precisely positioned within the insulator passageways.

It is another object of this invention to provide contacts which are particularly formed for precise location on an insulator housing whereafter the contacts are securely engaged by a secondary latch for secure retention within the insulator.

The above and other objects of this invention will become apparent from the following detailed description when read in the light of the accompanying drawing and appended claims.

SUMMARY OF THE INVENTION

In one embodiment of this invention a connector insulator is provided having a least one contact-receiving passageway extending therethrough. Such passageways are preformed to guide and position mating ends of the contacts within the passageways adjacent the mating face of the insulator. An insulator opening intersects the passageways to allow access to a projecting, locking, latch-engaging tab on each contact body from the insulator exterior. A spring tab integrally formed with each contact body prevents axial withdrawal of the contact from the insulator passageway in which disposed by engagement with a passageway stop shoulder after the contact is located in desired position within the insulator passageway. Each contact is in addition securely locked in the passageway in which disposed by secondary latching means having opposed locking arms received in mating grooves and openings formed on opposed side portions of the insulator housing. A resilient, unitary contact-latching arm is also integrally formed with the secondary latching means. The arm enters the intersecting insulator passageway for engaging the contact locking tabs and thereby securely retains the same within their insulator passageways.

In a modified secondary latching means construction, the secondary latchings means has a plurality of spaced latching arms. Such arms individually engage each of the spaced contacts and require small disengaging forces to release from the contacts as will hereinafter be described in greater detail.

For a more complete understanding of this invention, reference will now be made to the accompanying drawings wherein:

FIG. 3 is a front elevational view of the insulator of FIG. 2 of the drawing having a female contact in place.

FIG. 4 is a rear elevational view of the insulator of FIG. 2 of the drawing.

FIG. 5 is a longitudinal sectional view taken on line 5—5 of FIG. 4.

FIG. 6 is a sectional view, partly in elevation of the elements of FIG. 1 in assembled condition.

FIG. 7 is a plan view of a contact adapted to be employed with the insulator and latch of this invention in the process of formation.

FIG. 8 is a sectional view taken on line 8—8 of FIG. 7.

FIG. 9 is a perspective view of a further modified insulator and secondary latch made in accordance with the teachings of this invention, and FIG. 10 is a sectional view of the insulator and latch of FIG. 9 in assembled condition with electrical contacts in the insulator.

DESCRIPTION OF THE PREFERRED EMBODIMENTS

Figure 1:
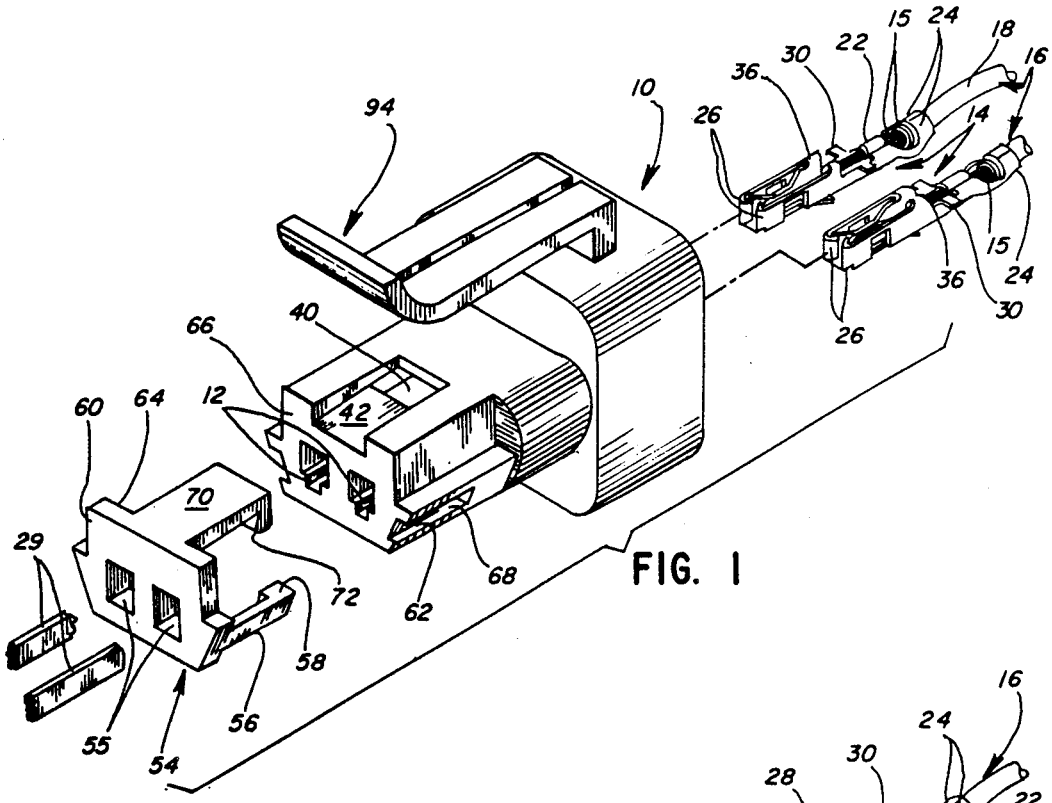
FIG. 1 is a perspective exploded view of an insulator secondary latch and electrical contacts made in accordance with this invention.

Referring now to FIG. 1 an insulator 10 made in accordance with this invention is therein illustrated which is adapted to receive contacts 14 in contact-receiving passageways 12. Opposed ends of the latter are clearly seen in the front and rear view of FIGS. 3 and 4 respectively. The electrical contacts 14 of FIG. 1 which are in electrical engagement with conductors 15 of wires 16 having outer insulating coatings 18 as seen in FIG. 1. FIG. 7 illustrates a contact 14*a* in the process of contact formation prior to engagement with the conductors 15 of FIG. 1 and while still integral with a carrier strip 21. Contacts 14*a* are formed of stamped metal followed by bending into the form illustrated in FIGS. 7 and 8.

Contacts 14 have a center channel 20 for reception of a wire 16 whereafter conductor-engaging tabs 22 more clearly seen in FIG. 8 are crimped over bare conductor 15 to establish electrical communication therewith. Adjacent contact tabs 24 are formed over the insulating coating of each wire 16 for purposes of assisting in retention of the wire to the contact. End portions 26 of each contact 14 define a receiving jaw opening wherein a male blade or pin may enter the contact 14 for reception between contact surfaces 28 which are closely spaced adjacent each other thereby assuring a desired wiping contact between such male pin or blade and the female contact 14 secured to the wire 16. FIG. 1 illustrates blade male contacts 29 which may mate with contacts 14.

Each contact also possesses opposed stop-guides 30 more clearly seen in FIG. 7 which are generally wing-shaped and slidably received in opposed guide grooves 32 more clearly seen in the insulator rear view of FIG. 4. FIG. 5 is a longitudinal sectional view illustrating the location of a contact 14 when fully inserted in an insulator passage 12. In the desired contact position illustrated in FIG. 5 in which contact 14 is seen in top plan view, the leading edges L of the guide stops 30 engage stops S disposed at the ends of guide grooves 32. Stops S comprise the ends of grooves 32 molded in the insulator body as a portion of passageway 14. With contacts 14 disposed in the position illustrated in FIG. 5, a locking tab 36 of each contact 14 will have a rear edge surface R thereof in desired, predetermined position relative to an insulator opening 40 seen in FIG. 1.

In the assembly view of FIG. 6 in which the insulator is illustrated in longitudinal section, it will be noted that upper surface portion 42 of the insulator in front of opening 40 is upwardly inclined. It is also apparent from FIG. 6 that struck out from a bottom portion of contact 14 is a primary locking tab 46 which is resiliently biased downwardly as viewed in FIG. 6 so as to snap into receiving recess 48. It will be apparent from FIG. 6 that upon attempted withdrawal of contact 14 from insulator opening 12, primary locking tab 46 will strike stop surface 50 defining one end of recess 48 thereby preventing contact withdrawal. Primary contact locking tab 46 is thus seen to be a contact element for positioning and retaining the contact in assembly with the insulator. However, upon the exertion of a large axial force intending to remove the contact 14 rearwardly from the insulator passageway 12, locking tabs similar to tab 46, have been known to shear free of the contact body thereby resulting in undesired release of the contact from the insulator body.

In accordance with this invention, a secondary latching means 54 of FIG. 1 is provided having opposed securing arms 56 including terminal locking detents 58. The arms 56 are resiliently mounted, relative to apertured face 60 of the illustrated latch 54 whereby such arms may flex as the locking detents 58 slidably engage opposed receiving slots 62 formed in opposed side surfaces of the insulator 10 as clearly seen in FIG. 1. When inner face 64 of secondary latch 54 engages face 66 of insulator 10, detent ends 58 of the secondary latch 5 will be received in receiving openings 68 disposed at the ends of grooves 62 of the insulator 10.

It will be evident from FIG. 1 that simultaneously with the interlock between the locking arms 56 of the secondary latching means 54 and insulator 10, a central latching arm or finger 70 will slidably engage inclined ramp surface 42 of the insulator 10 thereby stressing arm 70 so that the arm detent 72 will snap into insulator opening 40 resulting in the assembly illustrated in FIG. 6. It will be noted from FIG. 6 that detent 72 of the secondary latch arm 70 is disposed behind edge surface R of the contact locking tabs 36, securely locking the contact in place within the insulator passageway until released by arm 70. It will also be seen in FIG. 6 that contact locking tabs 36 are downwardly relieved to provide an angle of approximately 5° on their rear edges to mate with the detent 72 of latch arm 70 which detent has a bulbous cross-section to provide a desired detent-edge mating interfit.

It is thus seen in the assembly of FIG. 6 that each contact 14 is locked to insulator 10 not only by its primary locking tab 46 but also by the more massive and stronger latch arm 70 of the secondary latch 54. It is also evident from FIG. 6 that the face 60 of the secondary latch 54 has male contact-receiving openings 80 of lesser sectional area than the end openings of the contact receiving passageways 12 more clearly seen in FIGS. 1 and 3. Such reduced area is formed by converging side walls as seen in FIG. 1 which terminate in a rear opening of desired size in rear face 64 of secondary latch 54. As a result a male blade contact or pin contact adapted to be inserted between contact wall portions 28 more clearly seen in FIG. 7 will be efficiently guided into mating engagement with the female contact 14. Such guiding action avoids the danger of a male contact striking an insulator surface which may result in damage to the end portion of the male contact, and also avoids damage to an end portion of the female contact by the entering mating blade or pin end which might otherwise be occasioned by contact misalignment.

The secondary latch 54 of FIG. 1 discloses the use of a unitary latching arm 70. In an alternate secondary latch construction illustrated in FIG. 2 spaced latch arms 70*m* are formed integrally with opposed securing arms 56*m*. Each latch arm 70*m* has a terminal detent 72*m*, and the two detents are received in parallel grooves or ramps 78*m* formed in an upper end portion of the insulator 10*m*. Each latch arm detent 72*m* rides up its respective ramp surface 78*m* and enters an opening 40*m* disposed at the ends of the ramps 78*m* into which the latch arm detent 72*m* may be resiliently urged for precisely the same latching action with the contact locking shoulders as is illustrated in FIG. 6 of the drawing. The locking engagement of the secondary latch securing arms 56m received in grooves 62m and openings 68m of the insulator 10m is precisely the same as above described with respect to the secondary latch and insulator of FIG. 1.

Figure 2:
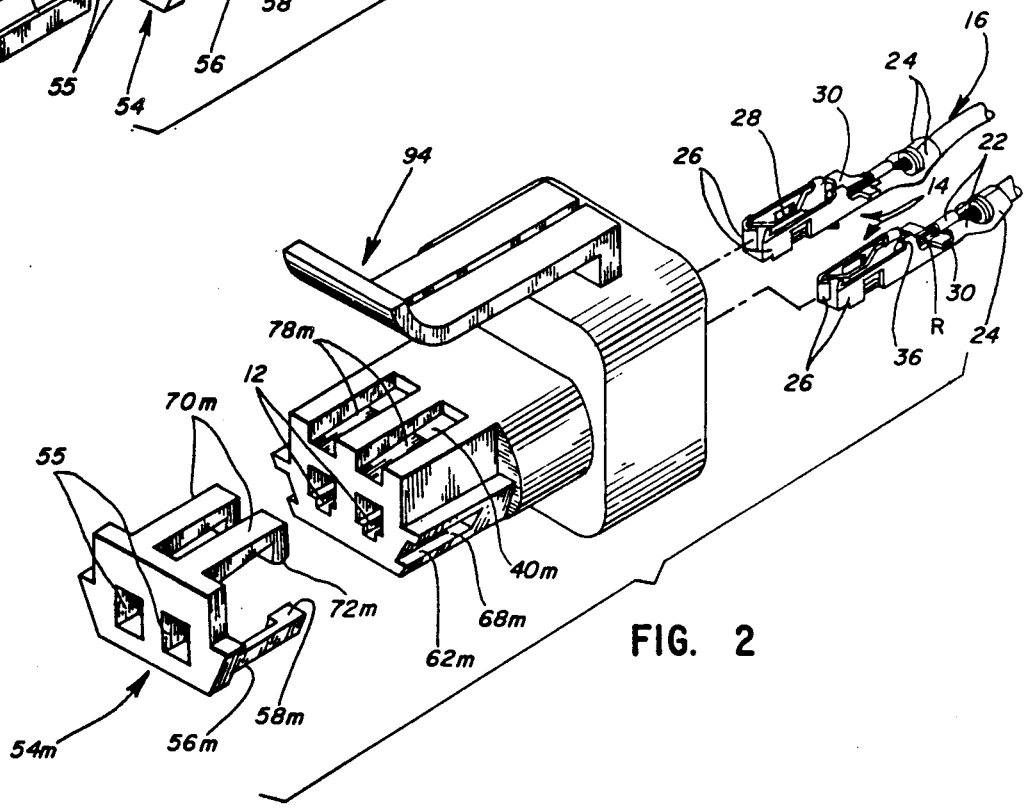
FIG. 2 is a perspective view similar to FIG. 1 of a modified insulator and secondary latch made in accordance with this invention.

Arms 94 secured to and projecting from an upper surface portion of each of the insulators 10 and 10m of FIGS. 1 and 2 respectively and having a central slot with an upwardly curved distal end is intended for latching to the housing of a mating plug connector in a manner known in the art. Such plug has male contacts to be initially received in openings 55 formed in the outer face of each secondary latch 54 and 54m prior to mating with contacts 14.

It is evident that the number of female contacts disposed in either insulator 10 or 10m vary from one to as many may be accommodated and aligned in the insulator body.

It is also believed apparent from a comparison of FIGS. 1 and 2 that the force for disengaging the individual latching arms 70m FIG. 2 is less than that for disengaging the larger latching arm 70 of FIG. 1. It is further apparent that the width of an integral latch finger is directly proportional to the number of aligned contacts in an insulator body. Thus the desirability of employing individual latching arms such as arms 70m of FIG. 2 increases with the number of aligned contacts housed in an insulator.

It should be further noted that as illustrated in FIG. 9, contact-receiving passageways such as passageways 12 in insulator body 99 may be arranged in superposed rows. Correspondingly, latch arms 98 of the modified secondary latch 100 may extend from both the top and bottom thereof. Such opposed combination contact-engaging and insulator-gripping arms dispense with the need for securing arms such as arms 56 and 56m of FIGS. 1 and 2. The opposed arms 98 thus serve as means for both securing the secondary latch 100 to modified insulator body 99 having the overlying rows of contact-receiving passageways and for securing opposed rows of contacts 14 to insulator 99. In this connection, FIG. 9 illustrates insulator body 99 having superposed passageways 12 in which contacts such as those illustrated in FIG. 1 of the drawing are received. The interior of the insulator is substantially the same as in the above-described figures of the drawings. A main structural difference in insulator 99 comprises the latch-receiving openings such as opening 40 of FIG. 1 and 40m of FIG. 2 in both top and bottom surfaces of the insulator so that the shoulders of the contacts may be engaged by the detents of the latch arms 98 employed therewith.

FIG. 10 is a sectional view illustrating insulator 99, secondary latch 100 and overlying contacts 14 in a state of interlocked assembly.

FIGS. 9 and 10 are thus seen to illustrate a modified secondary latch 100 and modified insulator 99 in which the latch has opposed contact-engaging latching arms 98 with detents 101, and the insulator 99 has superposed rows of contacts. The contacts 14 are inserted in the receiving passageways 12 of the insulator 99 in such a manner that the contact locking shoulders R are engageable by the latching arm detents 101 of the secondary latch 100. Accordingly the contacts in the bottom row of insulator passageways 12 of the insulator 99 are inverted so that the locking shoulders R of the contacts are accessible to a latch arm detent 101 in the bottom insulator opening 40 *m*. The passageways 12 of the insulators described above are such that the contacts may be inserted into the passageways in positions 180° apart.

It will be noted from FIG. 5 that the provided insulators may be made water resistant by association with bellows B known in the art, to render the openings substantially water tight.

It is believed apparent from the foregoing therefore that a connector construction has been provided employing a secondary latch means which assures secure retention of contacts within the insulator housing. Such engaged contacts are highly resistant to axial pull forces tending to remove such contacts from the housing in which disposed.

The constructions described above are simple in details of construction, and the insulators described may be formed in the absence of more complicated and expensive side core molding techniques comprising a distinct cost advantage in the manufacture of the same. The specific form of the contacts employed with the housings are not of critical importance although it is necessary for the contacts to have locking shoulders for engagement with cooperating detents of a secondary latch. The contacts may be interfitted with the insulator-receiving passageways by means other than those described for purposes of precisely locating the contacts in the insulators.

The contacts may be formed of known copper-beryllium or phosphorous-bronze alloys or other composition of desired electrical conductivity and be appropriately plated for enhanced conductivity. The female socket or insulator body described above may be formed of any of a variety of plastics known in the art. The secondary latch is preferably formed of plastics having good resiliency and desired strength properties for the functions described. The invention described above may also have applicability in insulator plugs.

A further latch and insulator modification which dispenses with the need for side security arms 56 and 56m of FIGS. 1 and 2 comprises a secondary latch similar to latch 100 of FIG. 9 in which the bottom arms merely fit in an insulator recess or recesses without engaging contacts or entering contact passageways. It is evident from the drawings that in the various latch-arm-insulator engagements illustrated the latch arm detents are captured in the insulator receiving openings so as to provide lateral stability of the secondary latch.

It is believed apparent that other modifications may be made in the structure above described in detail which modifications are within the ambit of the invention disclosed. This invention is limited therefore only by the scope of the appended claims.

What is claimed is:

1. In an electrical connector construction, a connector insulator having at least one open-ended contact-receiving passageway for housing a contact therein for engaging a mating contact of a second connector; said insulator having means in said passageway for locating a contact received in the passageway thereof relative to a first end of said passageway; said insulator having a second opening therein intersecting said contact-receiving passageway for providing communication between said contact-receiving passageway and the exterior of said insulator; latch means exteriorly disposed of said insulator, interlockingly engaging said insulator and having a latch finger with a detent portion; said detent portion being receivable in said insulator second opening for engaging a contact disposed in said insulator passageway whereby such contact may be latched in said insulator passageway to said insulator; connector construction of said latch means having an opening of lesser cross section than that of said insulator passageway for guiding a contact adapted to mate with a contact latched in position in said insulator into engagement with such latched contact.

2. In an electrical connector construction, a connector insulator having at least one open-ended contact-receiving passageway for housing a contact therein for engaging a mating contact of a second connector; said insulator having means in said passageway for locating a contact received in the passageway thereof relative to a first end of said passageway; said insulator having a second opening therein intersecting said contact-receiving passageway for providing communication between said contact-receiving passageway and the exterior of said insulator; latch means exteriorly disposed of said insulator, interlockingly engaging said insulator and having a latch finger with a detent portion; said detent portion being receivable in said insulator second opening for engaging a contact disposed in said insulator passageway whereby such contact may be latched in said insulator passageway to said insulator; said insulator having opposed grooves with detent-receiving openings disposed at the groove ends, and said latch means having opposed resilient arms including detents for engaging the insulator detent-receiving openings when such contacts and latch means are in the interlocked condition.

3. The electrical connector construction of claim 1 or 2 in which said latch finger is resilient and said insulator has an inclined surface for stessing said latch finger prior to entry of the detent portion into said insulator passageway in the normal course of interlocking engagement.

4. The electrical connector construction of claim 1 or 2 in which said insulator has a plurality of horizontally aligned contact-receiving passageways and said latch means has a single latch finger the detent of which engages contacts disposed in said plurality of passageways by traversing a single insulator opening.

5. The electrical connector construction of claim 1 or 2 in which said insulator has a plurality of horizontally aligned contact-receiving passageways and at least one opening for interconnecting each insulator passageway with the insulator exterior, and said latch means has a plurality of discrete latch fingers for latching contacts disposed in said insulator passageways to said insulator.

6. In an electrical connector construction, a connector insulator having at least one open-ended contact-receiving passageway for housing a contact therein for engaging a mating contact of a second connector; said insulator having means in said passageway for locating a contact received in the passageway thereof relative to a first end of said passageway; said insulator having a second opening therein intersecting said contact-receiving passageway for providing communication between said contact-receiving passageway and the exterior of said insulator; latch means exteriorly disposed of said insulator, interlockingly engaging said insulator and having a latch finger with a detent portion; said detent portion being receivable in said insulator second opening for engaging a contact disposed in said insulator passageway whereby such contact may be latched in said insulator passageway to said insulator; said insulator having guide grooves formed on opposite sides of each contact-receiving passageway; an electrical contact having opposed guides receivable in said guide grooves; the ends of said grooves comprising stops for precisely locating said contacts in said passageways.

7. In an electrical connector construction a connector insulator having a contact-receiving passageway formed for locating an electrical contact received therein in predetermined position in said passageway; an insulator opening intersecting said contact-receiving passageway and communicating with the insulator exterior; latch means interlockingly engaging said insulator and having a latch finger with a detent portion; said detent portion being receivable in said insulator opening for engaging a contact in predetermined position in said passageway in the normal position of insulator-latch means interlocking engagement, whereby such contact may be latched to said insulator; said latch means having an opening of lesser cross section than that of said insulator passageway for guiding a contact adapted to mate with a contact latched in position in said insulator into engagement with such latched contact.

8. In an electrical connector construction a connector insulator having a contact-receiving passageway formed for locating an electrical contact received therein in predetermined position in said passageway; an insulator opening intersecting said contact-receiving passageway and communicating with the insulator exterior; latch means interlockingly engaging said insulator and having a latch finger with a detent portion; said detent portion being receivable in said insulator opening for engaging a contact in predetermined position in said passageway in the normal position of insulator-latch means interlocking engagement, whereby such contact may be latched to said insulator; said insulator having opposed grooves with detent-receiving openings disposed at the groove ends, and said latch means having opposed resilient arms including detents for engaging the insulator detent-receiving openings when such contacts and latch means are in the interlocked condition.

9. In an electrical connector construction a connector insulator having a contact-receiving passageway formed for locating an electrical contact received therein in predetermined position in said passageway; an insulator opening intersecting said contact-receiving passageway and communicating with the insulator exterior; latch means interlockingly engaging said insulator and having a latch finger with a detent portion; said detent portion being receivable in said insulator opening for engaging a contact in predetermined position in said passageway in the normal position of insulator-latch means interlocking engagement, whereby such contact may be latched to said insulator; said insulator having guide grooves formed on opposite sides of each contact-receiving passageway; an electrical contact having opposed guides receivable in said guide grooves; the ends of said grooves comprising stops for precisely locating said contacts in said passageways.

10. In an electrical connector construction a connector insulator having a plurality of contact-receiving passageways formed therein for locating electrical contacts in predetermined position in said passageways; a plurality of insulator openings intersecting said contact-receiving passageways and communicating with the insulator exterior; latch means having spaced latch fingers with detent end portions; said detent end portions being receivable in said insulator openings for engaging contacts in predetermined position in said passageways in the normal position of insulator-latch means engagement, whereby such contacts may be latched to said insulator; said spaced latch fingers also engaging spaced portions of said insulator defining said insulator openings whereby said latch means may be latched to said insulator; said insulator having guide grooves formed on opposite sides of each contact-receiving passageway; an electrical contact having opposed guides receivable in said guide grooves; the ends of said grooves comprising stops for precisely locating said contacts in said passageways.

11. In an electrical connector construction, a connector insulator having at least one open-ended contact-receiving passageway for housing a contact therein for engaging a mating contact of a second connector adapted to mate with said insulator; said insulator having an opening therein for providing communication between said contact-receiving passageway and the exterior of said insulator; latch means interlockingly engaging outer surface portions of said insulator and having a manually engageable latch finger with a detent portion; said detent portion being receivable in said insulator opening for engaging a contact disposed in said insulator passageway whereby such contact may be latched in said insulator passageway to said insulator; said insulator having guide grooves formed on opposite sides of each contact-receiving passageway; an electrical contact having opposed guides receivable in said guide grooves; the ends of said grooves comprising stops for precisely locating said contacts in said passageways.

12. The electrical connector construction of claim 1, 2, 7, 8, 9, 10 or 11 in combination with an electrical contact having a resilient detent; a recess formed in insulator portions defining each of said passageways for receiving said resilient detent; said contact detent and insulator recess being so relatively disposed as to prevent movement of said contact in one axial direction.

13. The electrical connector of claims 2, 6, 7, 8, 9, 10 or 11 in which said insulator is a female receptacle.

14. The electrical connector construction of claims 6, 9, 10 or 11 in which said contact has a locking tab accessible to the detent portion of said latch finger through said insulator opening when positioned in said passageway.

* * * * *